US008459337B2

(12) United States Patent
Seidler et al.

(10) Patent No.: US 8,459,337 B2
(45) Date of Patent: Jun. 11, 2013

(54) APPARATUS INCLUDING A HEAT EXCHANGER AND EQUALIZING VESSEL

(75) Inventors: Siegfried Seidler, Villingen-Schwenningen (DE); Walter G. Angelis, St. Georgen (DE); Wolfgang Laufer, Aichhalden (DE); Francisco Rojo Lulic, St. Georgen (DE)

(73) Assignee: Papst Licensing GmbH & Co. KG, St. Georgen (DE)

( * ) Notice: Subject to any disclaimer, the term of this patent is extended or adjusted under 35 U.S.C. 154(b) by 1162 days.

(21) Appl. No.: 11/722,154

(22) PCT Filed: Dec. 31, 2005

(86) PCT No.: PCT/EP2005/014154

§ 371 (c)(1), (2), (4) Date: Jun. 19, 2007

(87) PCT Pub. No.: WO2006/087031

PCT Pub. Date: Aug. 24, 2006

(65) Prior Publication Data

US 2009/0090494 A1 Apr. 9, 2009

(51) Int. Cl.

| | |
|---|---|
| ***F28F 7/00*** | (2006.01) |
| ***F28F 19/00*** | (2006.01) |
| ***F28D 15/00*** | (2006.01) |
| ***B01D 24/00*** | (2006.01) |
| ***B01D 29/00*** | (2006.01) |
| ***B01D 35/00*** | (2006.01) |

(52) U.S. Cl.

USPC ..... 165/81; 165/83; 165/104.33; 165/119; 210/184; 210/440

(58) Field of Classification Search

USPC ..... 165/11.1, 46, 73, 74, 75, 81, 82, 165/83, 104.33, 119, 134.1; 361/699, 700; 210/183, 184, 227, 440, 444

See application file for complete search history.

(56) References Cited

U.S. PATENT DOCUMENTS

| | | | | |
|---|---|---|---|---|
| 1,813,871 | A * | 7/1931 | Ayers | 165/74 |
| 2,201,314 | A | 5/1940 | Illsley | 123/174 |

(Continued)

FOREIGN PATENT DOCUMENTS

| | | |
|---|---|---|
| DE | 587 148 | 10/1933 |
| DE | 25 23 545 | 12/1975 |

(Continued)

OTHER PUBLICATIONS

Pat. Abs. of Japan, JP09-283 959-A, Itakura+/Aisin Seiki, pub. Oct. 31,1997.

(Continued)

*Primary Examiner* — Ljiljana Ciric
(74) *Attorney, Agent, or Firm* — Husch Blackwell LLP

(57) ABSTRACT

An apparatus may include a heat exchanger and an equalizing vessel for equalizing changes in coolant volume. The heat exchanger may include an inflow for delivering coolant to the heat exchanger and an outflow for discharging coolant from the heat exchanger. The equalizing vessel may be closed off by a flexible membrane that follows changes in volume of the coolant. The equalizing vessel may include a first chamber that is in liquid communication with the inflow of the heat exchanger and a second chamber that is in liquid communication with the outflow of the heat exchanger. A filter may also be provided to filter the coolant.

24 Claims, 12 Drawing Sheets

U.S. PATENT DOCUMENTS

| | | | | | |
|---|---|---|---|---|---|
| 2,432,475 | A | * | 12/1947 | Griffith | 210/183 |
| 2,670,185 | A | * | 2/1954 | Rothemund et al. | 165/83 |
| 3,481,393 | A | * | 12/1969 | Chu | 165/104.33 |
| 3,649,738 | A | * | 3/1972 | Andersson et al. | 165/46 |
| 3,693,825 | A | * | 9/1972 | Richman | 220/227 |
| 3,762,467 | A | * | 10/1973 | Poon et al. | 165/119 |
| 3,989,095 | A | * | 11/1976 | Voboril et al. | 165/104.26 |
| 4,064,911 | A | * | 12/1977 | Albrecht | 138/30 |
| 4,109,707 | A | * | 8/1978 | Wilson et al. | 165/46 |
| 4,130,159 | A | | 12/1978 | Ohta et al. | 165/111 |
| 4,138,692 | A | * | 2/1979 | Meeker et al. | 257/697 |
| 4,357,236 | A | * | 11/1982 | Krueger | 165/134.1 |
| 4,662,435 | A | * | 5/1987 | Bohlin | 165/119 |
| 4,721,996 | A | * | 1/1988 | Tustaniwskyj et al. | 361/699 |
| 4,729,060 | A | * | 3/1988 | Yamamoto et al. | 361/700 |
| 4,750,086 | A | * | 6/1988 | Mittal | 361/689 |
| 4,813,477 | A | * | 3/1989 | Hansen et al. | 165/119 |
| 4,831,980 | A | * | 5/1989 | Nasu et al. | 123/196 A |
| 4,878,536 | A | * | 11/1989 | Stenlund | 165/119 |
| 4,910,642 | A | * | 3/1990 | Downing | 361/690 |
| 4,939,621 | A | * | 7/1990 | Galian et al. | 361/689 |
| 4,951,740 | A | * | 8/1990 | Peterson et al. | 165/104.33 |
| 5,050,037 | A | * | 9/1991 | Yamamoto et al. | 361/699 |
| 5,147,130 | A | * | 9/1992 | Watanuki | 165/104.33 |
| 5,166,863 | A | * | 11/1992 | Shmunis | 361/699 |
| 5,183,104 | A | * | 2/1993 | Novotny | 165/104.33 |
| 5,241,131 | A | * | 8/1993 | Bakhru et al. | 361/689 |
| 5,326,461 | A | * | 7/1994 | Legrand et al. | 165/119 |
| 5,388,635 | A | * | 2/1995 | Gruber et al. | 165/46 |
| 5,406,807 | A | * | 4/1995 | Ashiwake et al. | 361/699 |
| 5,435,346 | A | * | 7/1995 | Tregidgo et al. | 165/119 |
| 5,471,850 | A | * | 12/1995 | Cowans | 361/700 |
| 5,476,139 | A | * | 12/1995 | Gire | 165/119 |
| 5,535,818 | A | | 7/1996 | Fujisaki et al. | 165/104.33 |
| 5,718,281 | A | * | 2/1998 | Bartalone et al. | 165/119 |
| 5,772,873 | A | * | 6/1998 | Hudgens et al. | 165/119 |
| 5,988,267 | A | | 11/1999 | Park et al. | 165/110 |
| 6,217,758 | B1 | * | 4/2001 | Lee | 210/184 |
| 6,544,412 | B2 | * | 4/2003 | Michels et al. | 210/440 |
| 6,585,887 | B2 | * | 7/2003 | Michels et al. | 210/440 |
| 6,746,600 | B2 | * | 6/2004 | Nguyen | 210/444 |
| 7,270,174 | B2 | * | 9/2007 | Chu et al. | 165/11.1 |
| 7,325,588 | B2 | * | 2/2008 | Malone et al. | 361/689 |
| 2006/0032625 | A1 | | 2/2006 | Angelis et al. | 165/247 |

FOREIGN PATENT DOCUMENTS

| | | |
|---|---|---|
| DE | 129 676 | 2/1978 |
| DE | 29 05 887 | 8/1980 |
| DE | 39 34 084 | 4/1991 |
| DE | 41 39 287 | 4/1992 |
| DE | 20 2004 014 911 U | 1/2005 |
| DE | 103 45 115 | 5/2005 |
| EP | 0 585 775 | 3/1994 |
| EP | 0 886 113 | 2/2003 |
| EP | 1 403 597 | 3/2004 |
| EP | 1 577 630 | 9/2005 |
| GB | 2 043 866 | 10/1980 |

OTHER PUBLICATIONS

Pat. Abs. of Japan, JP2000-299585-A, Suganama/Toyota, pub. Oct. 24, 2000.

Pat. Abs. of Japan, JP20004-218969-A, Oku/Univ. Tokyo, pub. Aug. 5, 2004.

* cited by examiner

APPARATUS INCLUDING A HEAT EXCHANGER AND EQUALIZING VESSEL

CROSS-REFERENCE

This application is a section 371 of PCT/EP05/014 154, filed 31 Dec. 2005, published 24 Aug. 2006 as WO-2006-087031-A.

FIELD OF THE INVENTION

The invention relates to a heat exchanger for cooling a cooling medium, in particular in an electrical/electronic device.

BACKGROUND

In a closed cooling system filled with a coolant, temperature changes as well as permeation, for example through tube walls, result in a change in the volume of the coolant. Some compensation or equalization for this coolant volume change, that ensures that no, or only small, pressure changes occur in the system, must be found.

Such changes in volume can be buffered by means of a so-called equalizing vessel. This causes additional costs, however, and also increases the risk of cooling medium leaking out.

An important problem in the context of heat exchangers for electronic devices is that their exact operating orientation is not known, a priori. This is true not least for transportation to the customer, since such cooling systems are already filled with cooling medium at the manufacturer's premises, and the orientation they will assume during transport cannot be predicted. The same is true for utilization in vehicles of all kinds (aircraft, ships, land vehicles, vehicles in a weightless state). Operating reliability must therefore be guaranteed in all conceivable operating orientations. If liquid were to mix with gas in the cooling circuit, reliable operation of a circulating pump would then no longer be guaranteed, with the result that cooling performance might rapidly decrease. This would then very quickly cause the electronic component being cooled either to switch itself off, or to be destroyed by the increase in temperature.

SUMMARY OF THE INVENTION

It is therefore an object of the invention to make available a novel heat exchanger.

According to the invention, this object is achieved by forming a two-part equalizing vessel, incorporating a flexible membrane which dynamically adapts to changes in coolant volume, as part of a heat exchanger, one part being implemented as part of the inflow and one part being implemented as part of the outflow of the heat exchanger. A compact and economical arrangement is thereby achieved. The risk that cooling medium may leak out and cause damage to the electronics is reduced. The at least one flexible membrane or diaphragm also causes the internal volume of the cooling circuit to be adapted automatically to the variable volume of the cooling medium that is present in the cooling circuit, so that the creation of gas bubbles in the cooling medium is prevented, regardless of the operating orientation of the heat exchanger. This makes possible reliable cooling even after the heat exchanger has temporarily assumed an unusual operating orientation, e.g. during transport.

A particularly preferred embodiment of such a heat exchanger is to join a heat exchanger to an equalizing vessel in a single module, incorporating a coolant filter at an interface therebetween. It prevents, at very low cost, problems and damage due to contaminants in the cooling medium.

The preferred refinement, according to which the filter is a plastic part directly attached to a housing of the equalizing vessel, yields a compact, robust, and cost-saving design.

BRIEF FIGURE DESCRIPTION

Further details and advantageous refinements of the invention are evident from the exemplifying embodiments, in no way to be understood as limitations of the invention, that are described below and depicted in the drawings.

DETAILED DESCRIPTION

Figure 1:
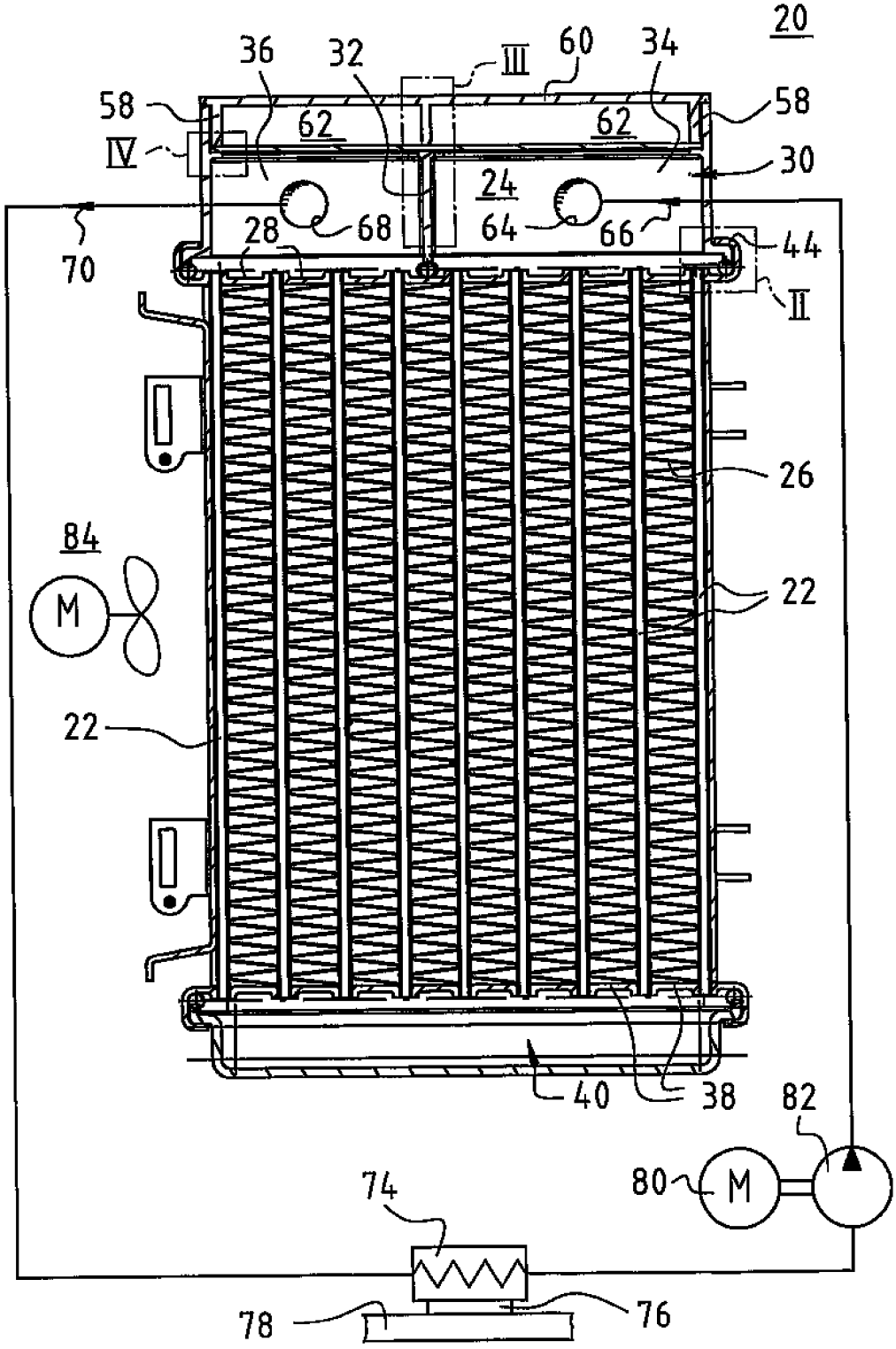
FIG. 1 is a schematic depiction showing, by way of example, a heat exchanger according to the invention and its arrangement in a cooling circuit.
Figure 2:
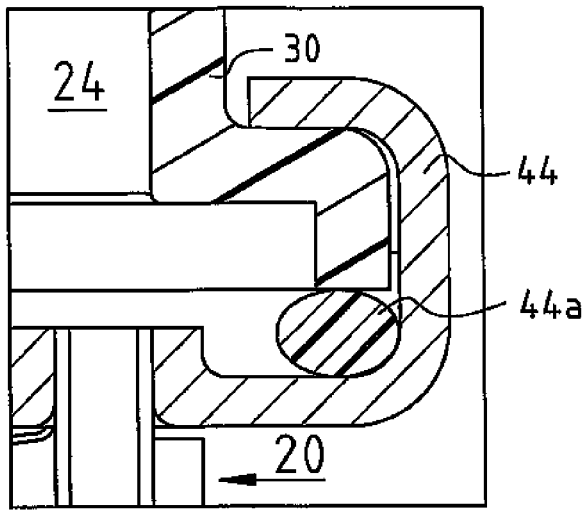
FIG. 2 is an enlarged depiction of detail II of FIG. 1.

FIG. 1 schematically shows a heat exchanger 20. The latter has, in known fashion, flat cooling tubes 22 through which a cooling medium 24 flows during operation, and which are joined in thermally conductive fashion to cooling plates 26 arranged in a zigzag shape.

The spaces between the flat tubes 22 are closed off at the top in liquid-tight fashion by closure panels 28, thus creating an upper tank 30 that is subdivided by a vertical partition 32 into an inflow-side chamber 34 and an outflow-side chamber 36.

The spaces between tubes 22 are likewise closed off at the bottom in liquid-tight fashion by closure panels 38, so that a lower tank 40 is formed there.

Figure 3:
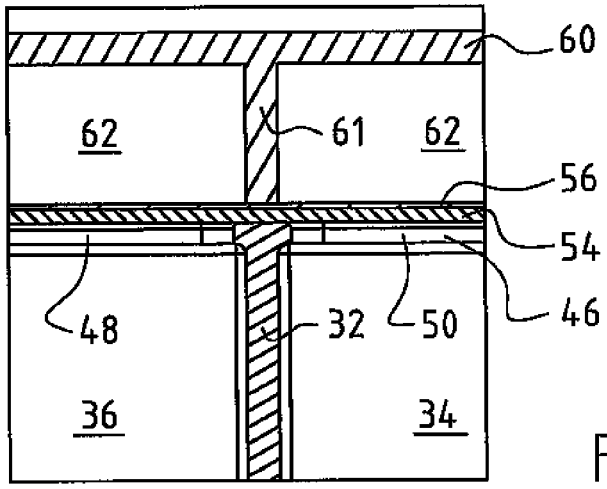
FIG. 3 is an enlarged depiction of detail III of FIG. 1.
Figure 4:
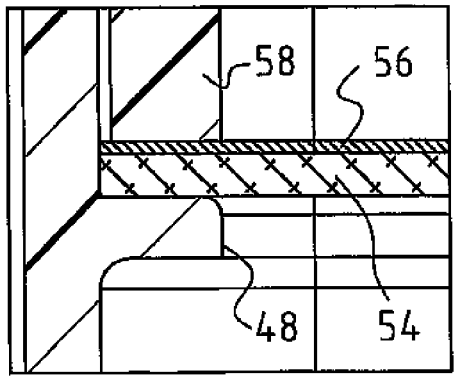
FIG. 4 is an enlarged depiction of detail IV of FIG. 1.

Upper tank 30 is joined in liquid-tight fashion to heat exchanger 20 by means of a crimped join 44. It has an upper wall 46 (FIG. 3) that is implemented here integrally with partition 32. Apertures are located in said wall, namely an aperture 48 above outflow-side space 36 and an aperture 50 above inflow-side space 34.

These apertures 48, 50 are hermetically closed off in liquid-tight fashion on their upper sides by a flexible membrane 54 on which rests a flat spring arrangement 56 made of non-corroding spring steel. This spring arrangement 56 is joined to membrane 54, for example, by vulcanization. For this purpose, spring arrangement 56 can also be vulcanized into membrane 54 in order to protect it particularly well from corrosion.

Diaphragm 54 and spring arrangement 56 are retained in fluid-tight fashion at their outer rim by the rim 58 of a cover 60. They are likewise retained at the center by a strut 61 of cover 60 (cf. FIG. 3). Air or an inert gas, e.g. nitrogen, is present in space 62 between cover 60 and membrane 54.

Upper tank 30 has an inflow 64, and through the latter cooling medium (hereinafter "coolant" for short) 24 flows in the direction of an arrow 66 to inflow-side chamber 34. From there, it flows downward through passages or tubes 22 located there to lower tank 40, and from the latter through the left-hand (in FIG. 1) tubes 22 upward to outflow-side chamber 36, i.e. the flow follows a switchback or two-direction-flow path. The flow direction can, of course, be the reverse in some cases.

From there the cooling medium flows through an outflow 68, in the direction of an arrow 70, to a heat sink 74 that is joined in thermally conductive fashion to an electronic component 76 that is arranged on a circuit board 78 and is supplied with current through the latter.

The cooling medium is heated in heat sink 74, and the heated cooling medium is delivered back to inflow 66 by means of a circulating pump 82 driven by an electric motor 80.

Heat exchanger 20 is cooled by air by means of a fan 84, this being indicated only very schematically.

Figure 5:
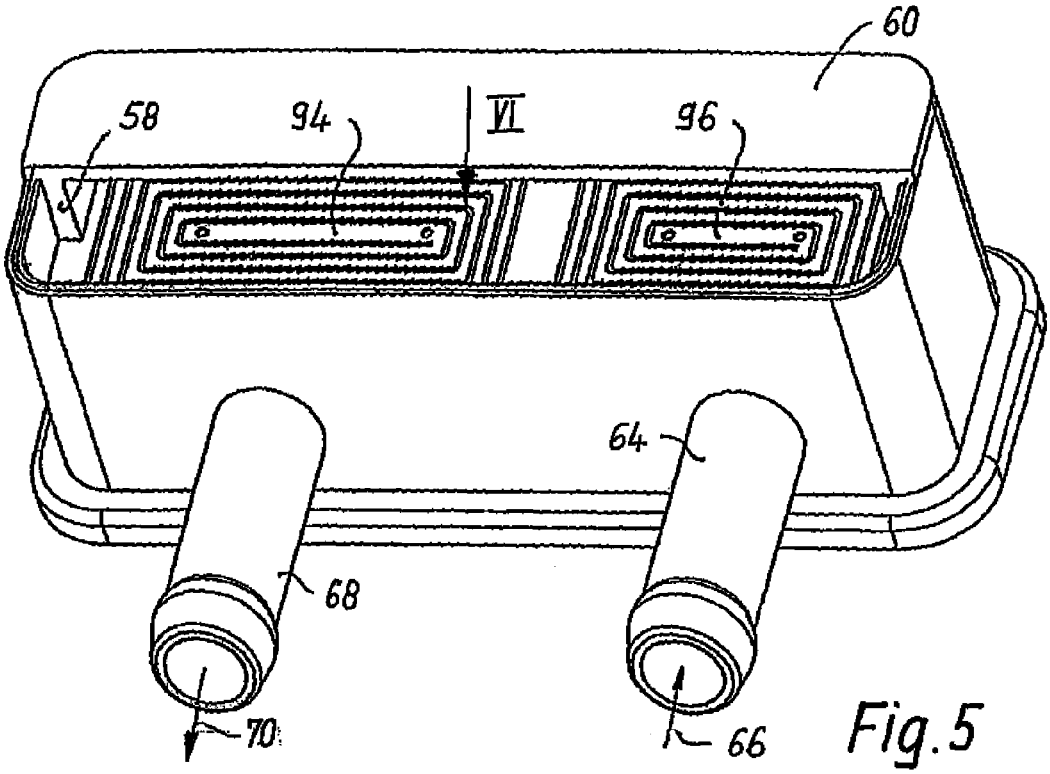
FIG. 5 is a three-dimensional depiction, shown partially in section, of an exemplifying embodiment according to the invention.
Figure 6:
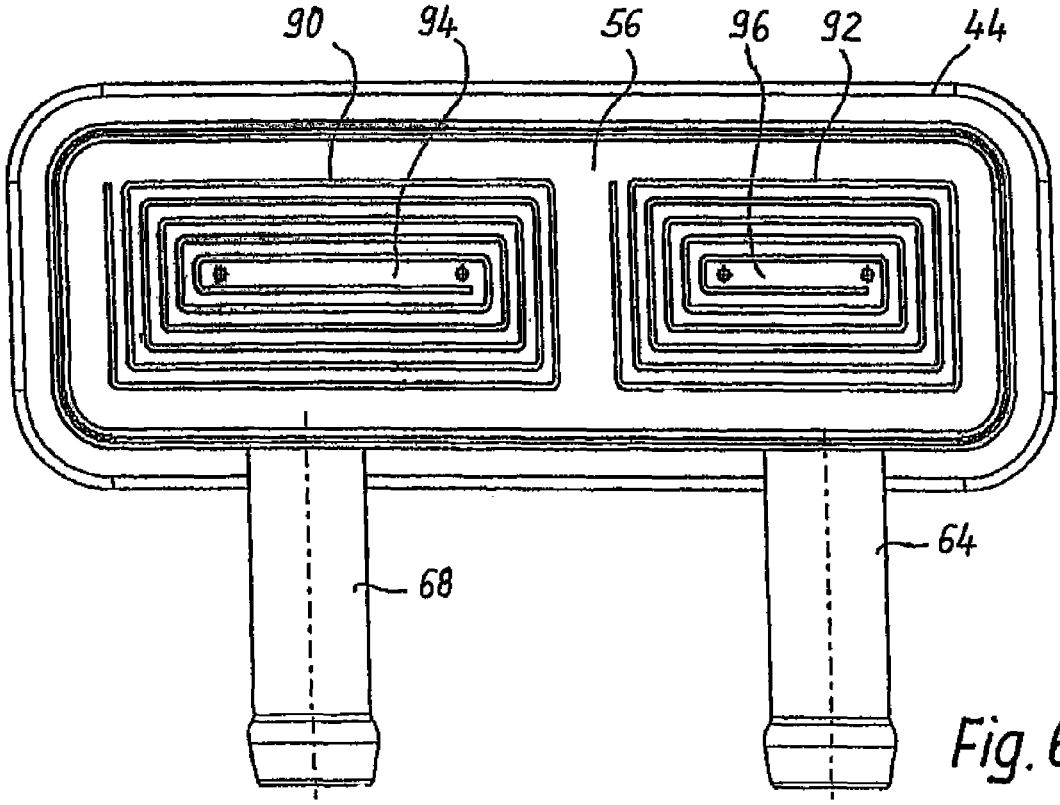
FIG. 6 is a depiction analogous to FIG. 5, viewed in the direction of arrow VI of FIG. 5.
Figure 7:
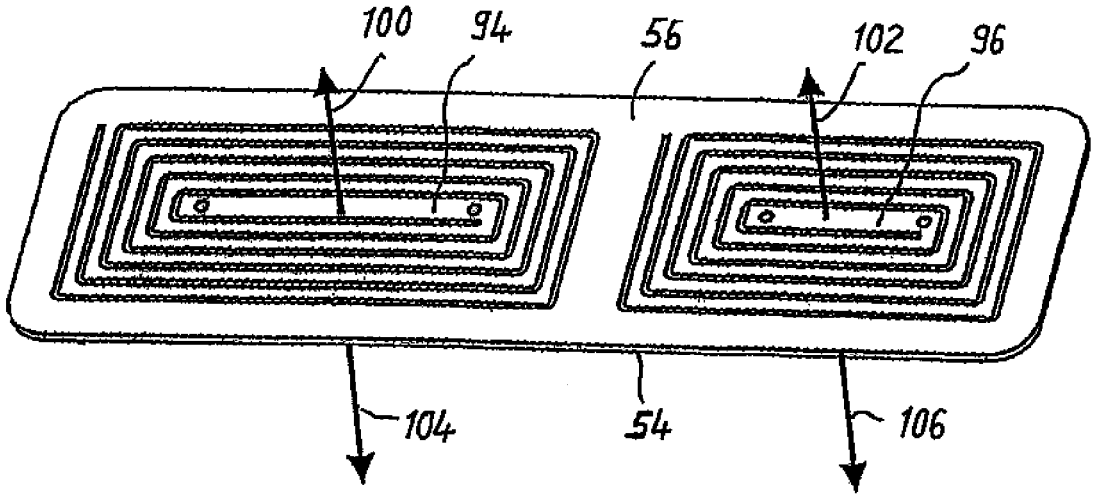
FIG. 7 is a three-dimensional depiction of the membrane used in the heat exchanger according to FIGS. 1 to 6 and of the spring element joined to it.

FIGS. 5 to 7 show the construction of spring arrangement 56. The latter is formed by the fact that a left-hand spiral-shaped aperture 90 and a right-hand spiral aperture 92 are incorporated into a thin sheet of spring steel, thereby creating at the left a larger spiral spring 94 that is associated with larger chamber 36, and at the right a smaller spiral spring 96 that is associated with smaller chamber 34.

Chambers 34, 36 are filled with cooling medium 24 up to membrane 54. When said medium expands, membrane 54 bulges upward above apertures 48, 50; springs 94, 96 prevent membrane 54 from protruding and being damaged at individual locations.

When cooling medium 24 contracts, membrane 54 bulges downward through apertures 48, 50; here again, springs 94, 96 ensure uniform deflection.

A reliably functioning equalizing vessel 30 is thereby obtained with little complexity.

In FIG. 7 the deflections described are depicted symbolically by arrows 100, 102 (upward) and 104, 106 (downward).

Figure 8:
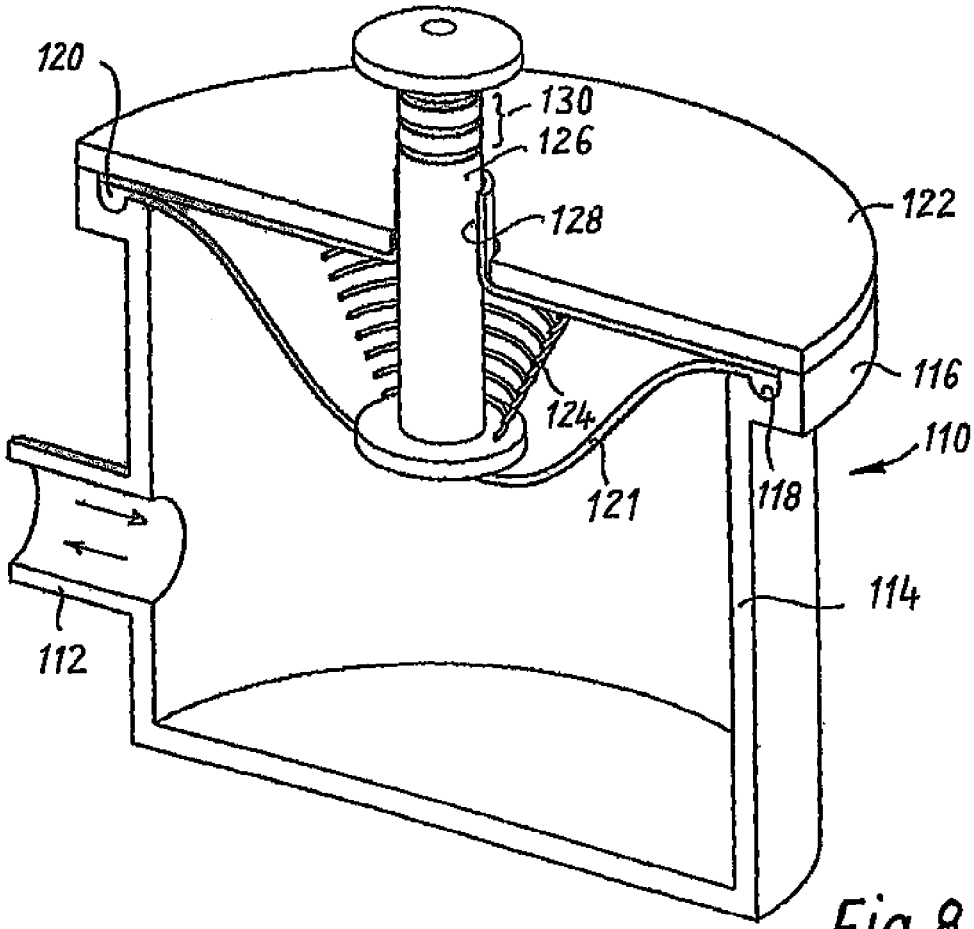
FIG. 8 shows a second exemplifying embodiment of the invention.

FIG. 8 shows an equalizing vessel 110 that has only a single connector 112 through which coolant flows in or out during operation. Vessel 110 has at the bottom a cup 114 at whose upper end is provided an outwardly projecting flange 116 in which an annular groove 118 is located. Engaging into the latter is a sealing bead 120 belonging to an elastic membrane 121, which bead is pressed sealingly into annular groove 118 by a cover 122. The mounting of cover 122 on cup 114 is not depicted because it is known.

Elastic membrane 121 is pressed downward at its center, in the manner shown, by a plunger 126 acted upon by a spring 124. Plunger 126 projects at the top through an opening 128 in cover 122 and is equipped there with a scale 130 for pressure indication. This plunger 126 facilitates venting, e.g. after a repair. Here as well, the space beneath membrane 121 is filled completely with coolant, i.e. with no air bubbles.

FIGS. 9 to 12 show a second, preferred exemplifying embodiment of the invention. Parts identical or functioning identically to those in FIGS. 1 to 8 are usually labeled with the same reference characters as therein, and are not described again.

Figure 9:
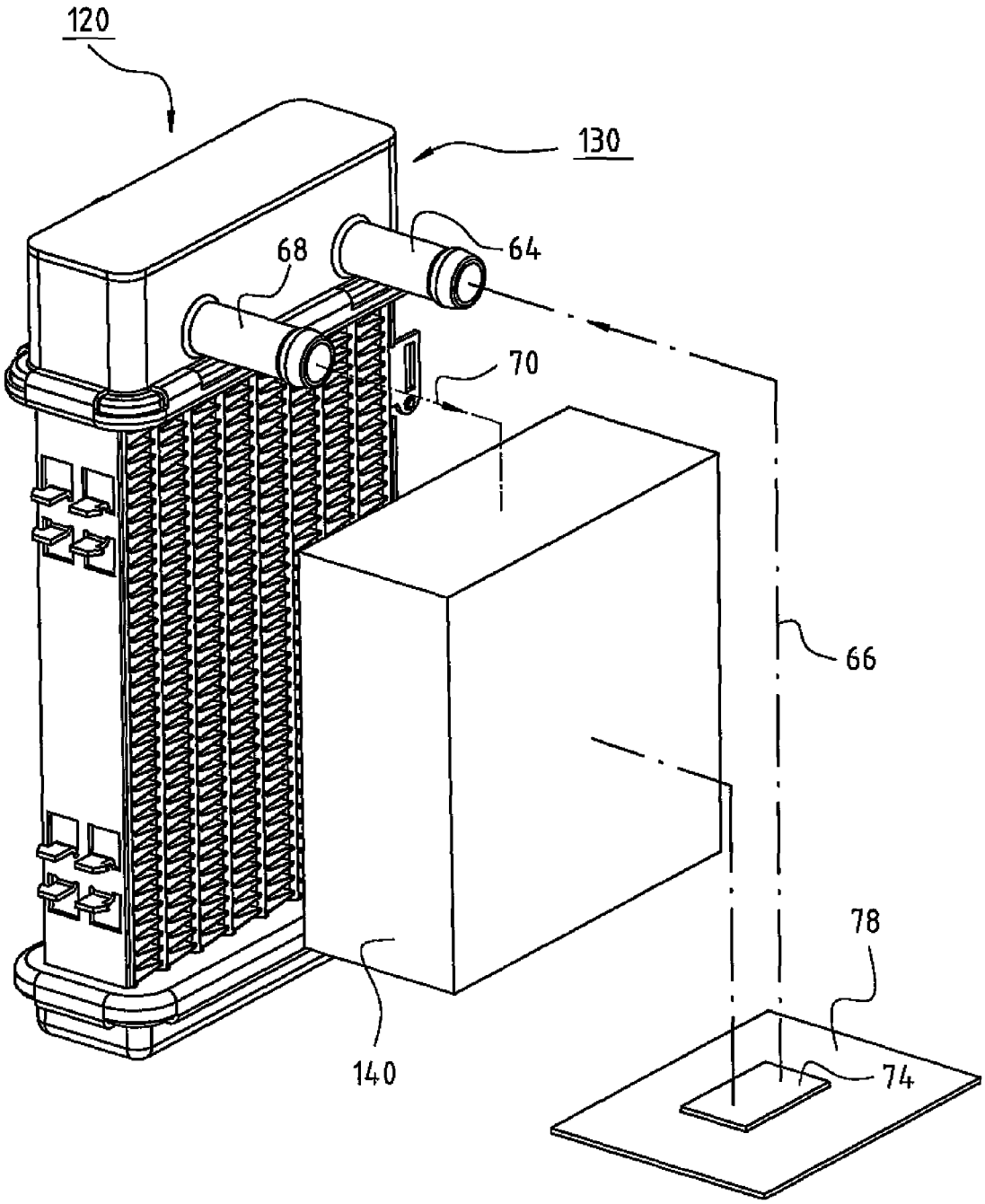
FIG. 9 is an overview of a second exemplifying embodiment of the invention.
Figure 10:
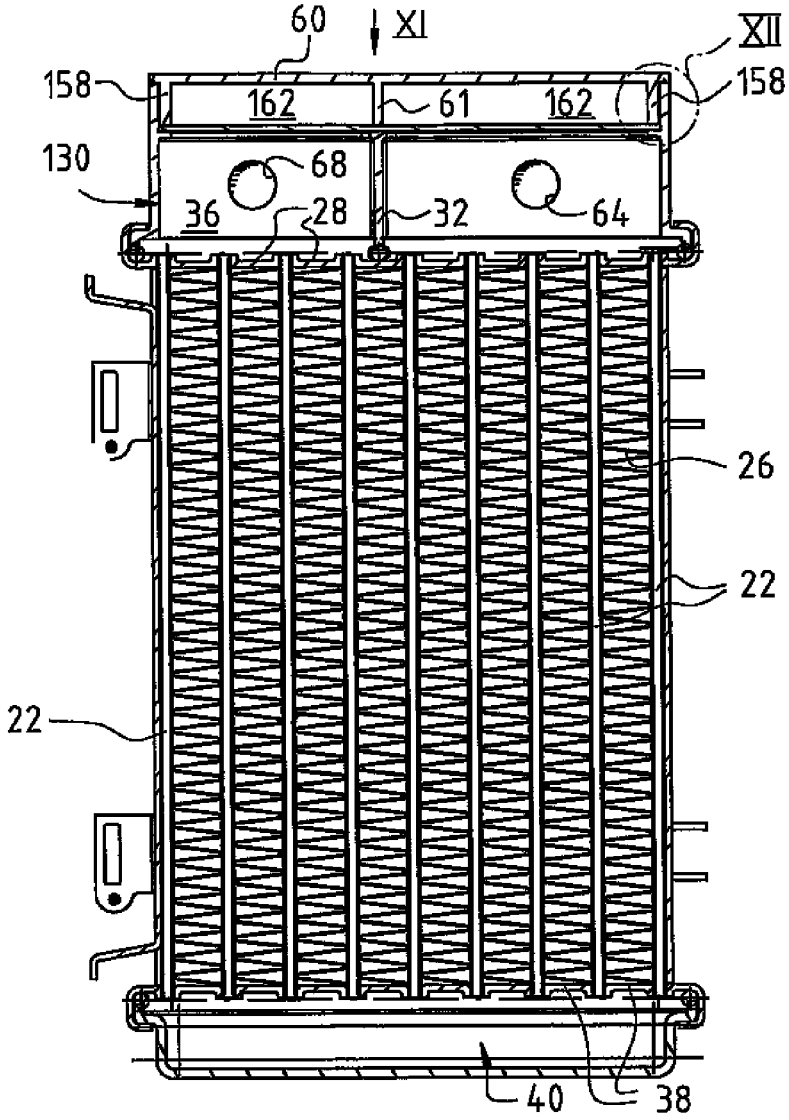
FIG. 10 is a section viewed along line X-X of FIG. 11.
Figure 11:
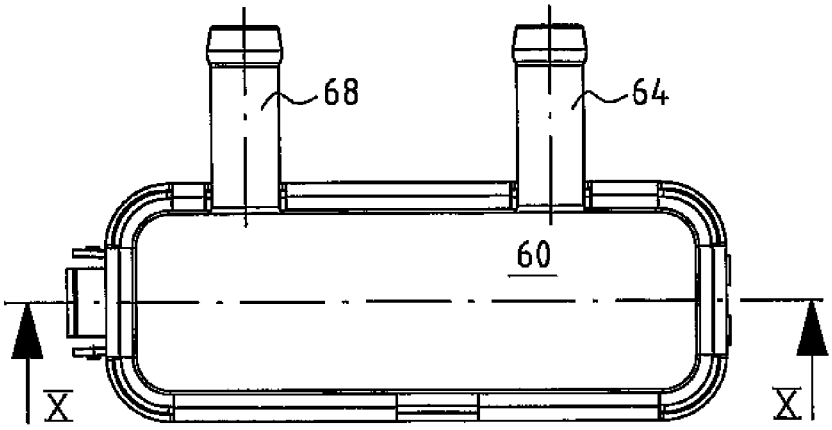
FIG. 11 is a top view looking in the direction of arrow XI of FIG. 10.

FIG. 9 is an overview image analogous to FIG. 1. The heated cooling fluid from heat absorber 74 is delivered via a conduit 66 to inflow 64 of heat exchanger 120, where it is cooled. From outflow 68, it flows via a conduit 70 to a unit 140. The latter contains a circulating pump for the cooling fluid (analogous to pump 82 of FIG. 1) and a fan (analogous to fan 84 of FIG. 1) to generate cooling air for heat exchanger 120. In contrast to FIG. 1, the fan and the circulating pump are driven by the same electric motor (cf. e.g. the Assignee's WO2004/031588A1, ANGELIS et al., whose U.S. phase is U.S. Ser. No. 10/527,471, published as US-2006-032 625-A.

Cooling channels 22, cooling plates 26, etc. are configured in the same way as in the first exemplifying embodiment according to FIGS. 1 to 8.

Figure 12:
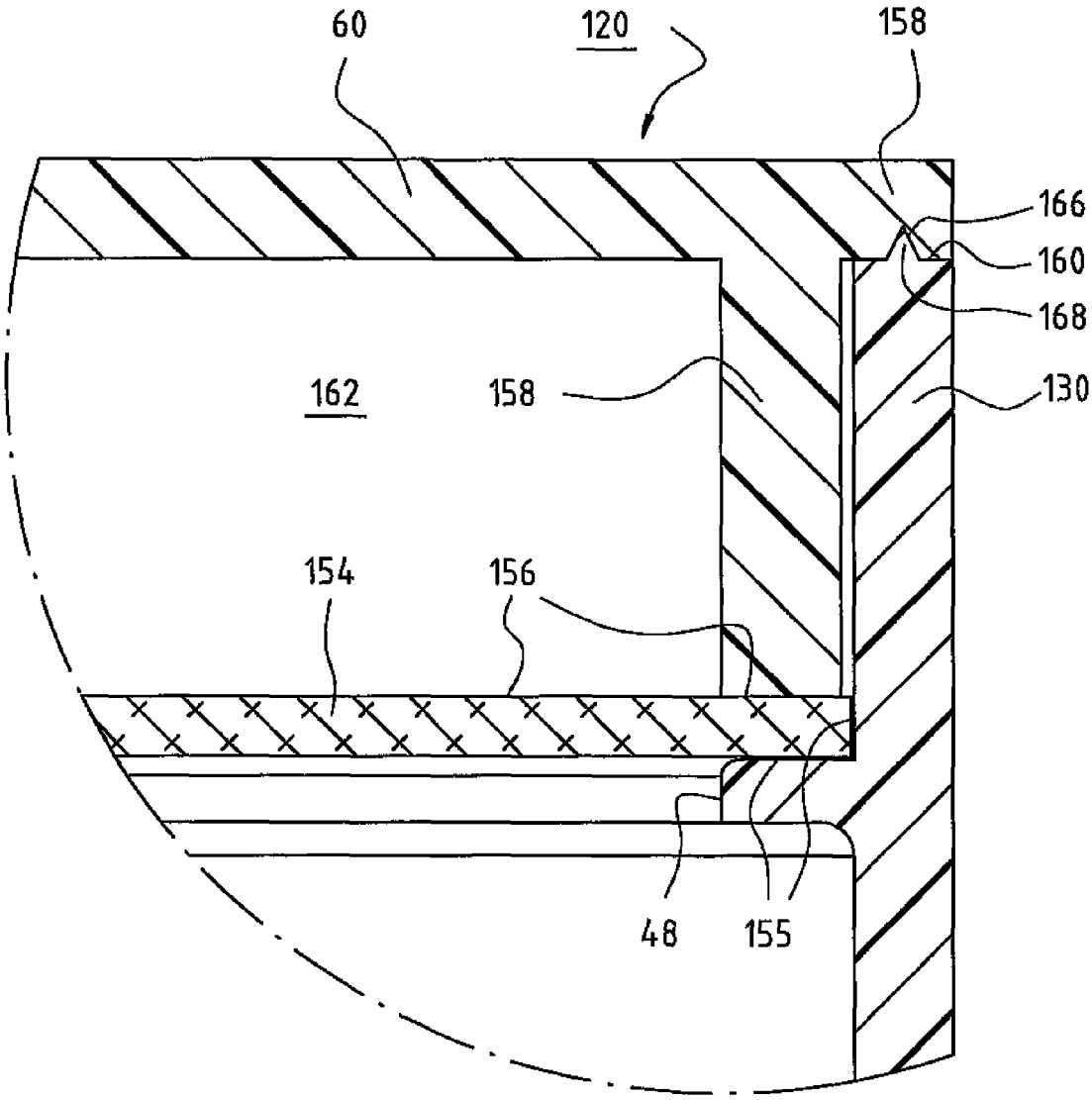
FIG. 12 is an enlarged depiction of detail XII of FIG. 10.

As shown particularly well by FIG. 12, heat exchanger tank 130 is manufactured from a thermoplastic by injection molding.

This tank 130 has an inwardly projecting flange 48, and in a second injection-molding step a flexible membrane 154 made of TPE (thermoplastic elastomer) is molded, as a soft component, onto the upper side of this flange 48. This method is also referred to as two-component injection molding. The seam is labeled 155.

Thermoplastic silicone elastomers that are made up of a two-phase block copolymer (polydimethylsiloxane/urea copolymer) are preferably suitable for membrane 154. A TPE-A (polyether block amide) can also be used if applicable.

Because the strength of the join between the thermoplastic material of tank 130 and the molded-on TPE of membrane 154 is not very high in the region of joining seam 156, cover 60 is used as additional security; this has a downwardly projecting portion 158' that rests with pressure on the welded-on rim of membrane 154 in region 156, i.e. along the entire periphery of membrane 154.

For this purpose, outer rim 158 of cover 60 is joined to upper rim 160 of tank 130, e.g. by laser welding, adhesive bonding, bolting, or by way of a latching join. FIG. 12 shows a join by means of a notch 166 and a projecting rim 168, which are joined by laser welding. Laser welding results, in space 162 between cover 60 and membrane 154, in an enclosed air cushion that braces membrane 154 toward the top and thereby relieves mechanical stress.

If too much oxygen diffuses into the cooling system through the plastic walls, it oxidizes the corrosion inhibitors contained in the coolant and gas bubbles may form; this can result in malfunctions in the cooling system and in some cases even a failure of the cooling system. If too much coolant diffuses outward through the plastic walls, at some time during the required service life (often approx. 60,000 hours) there will be too little coolant remaining in the system for it to continue functioning, and a failure then likewise occurs.

These requirements, in addition to the temperature and strength demands, limit the suitable materials.

Appropriate basic materials (hard components) for tank 130 are: polyphenylene oxide (PPO), glass-fiber reinforced; optionally also polypropylene (PP), likewise glass-fiber reinforced. Particularly suitable on the basis of present knowledge, in view of the requirement of very low permeability for water, glycol, or another coolant outward from the cooling circuit on the one hand, and for oxygen from outside into the coolant on the other hand, is polyphenylene sulfide (PPS), glass-fiber reinforced; or PA-HTN, a temperature-stabilized polyamide, likewise glass-fiber reinforced.

PA is very well suited for laser welding, PPS somewhat less so. PA is therefore preferred when suitable, including for price reasons.

What is achieved by means of the invention is that heat exchanger 120 can simultaneously also work as an equalizing vessel to allow the equalization of changes in the volume of cooling liquid; such changes are inevitable during extended operation, and can also occur as a result of temperature fluctuations.

Figure 13:
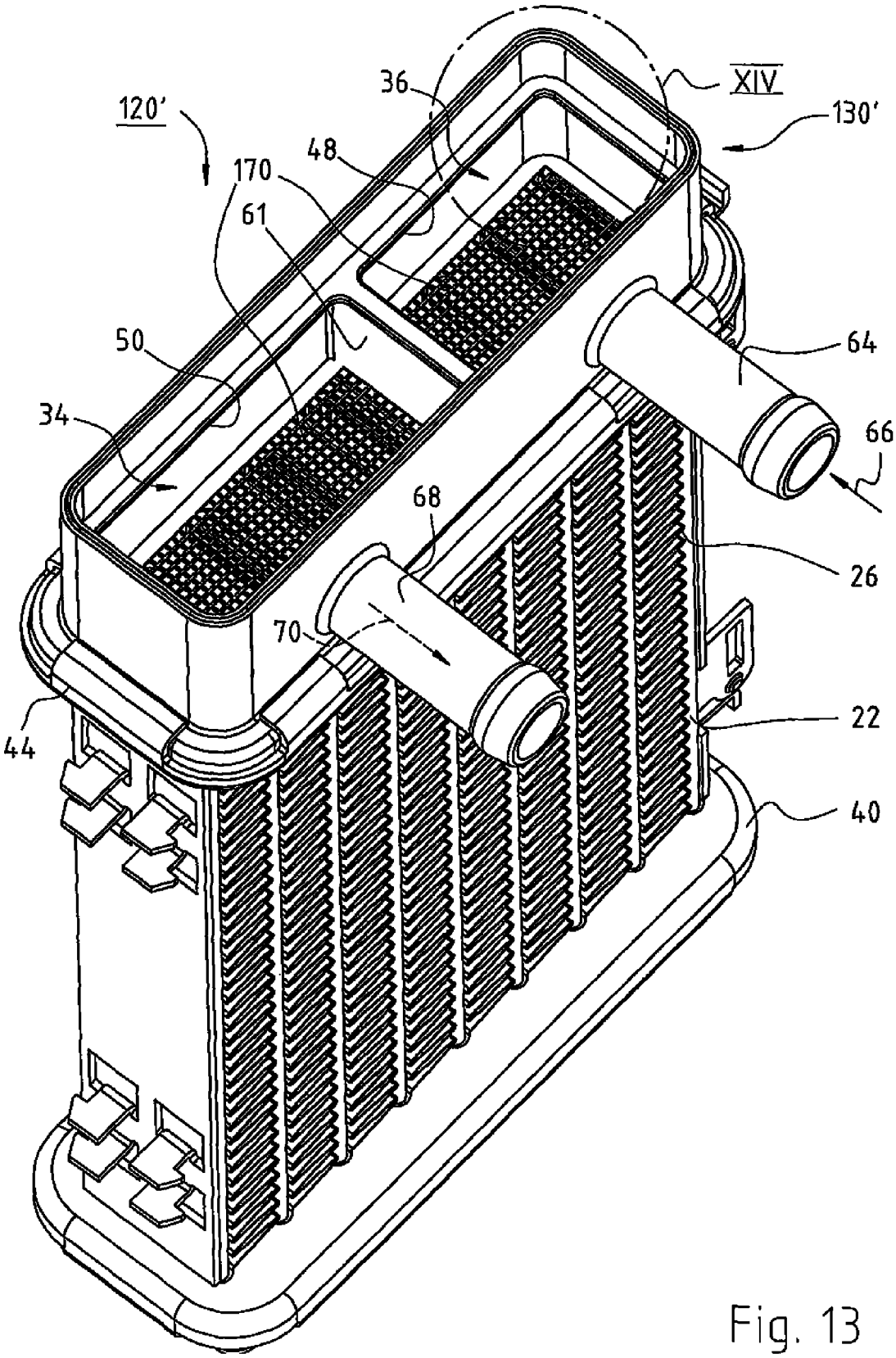
FIG. 13 is a three-dimensional depiction of a heat exchanger 130' that is equipped with an integrated large-area filter.
Figure 14:
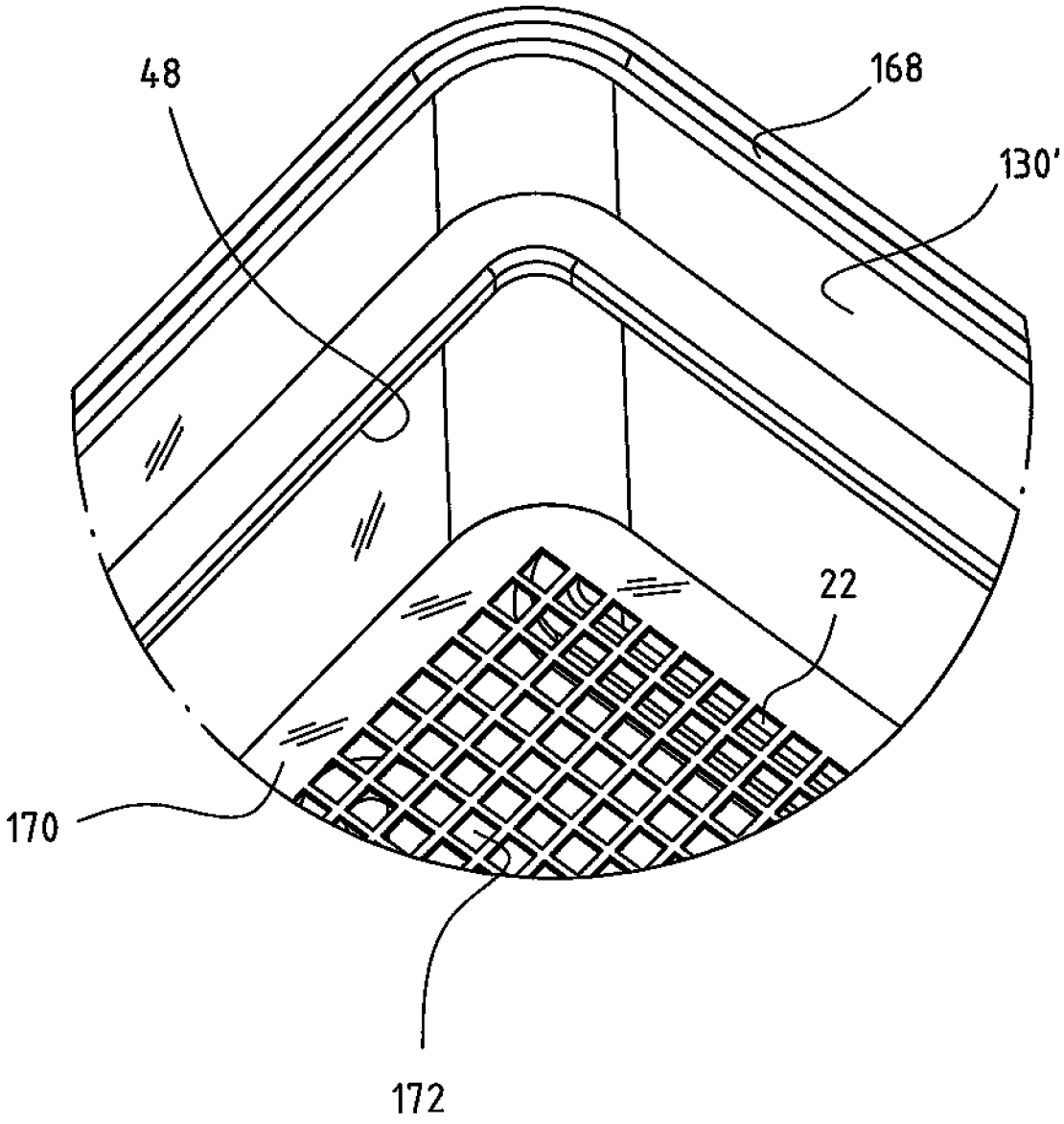
FIG. 14 is an enlarged depiction of detail XIV of FIG. 13.

FIG. 13 shows a heat exchanger 120' having an integrated filter 170. According to FIG. 14, this filter 170 has filter openings 172 that, for example, can be larger on inflow side 36 (on the right in FIG. 13) than on outflow side 34, in order to achieve firstly coarse filtration and then fine filtration. The portion of filter 170 that performs the coarse filtration could also be referred to as a sieve.

Figure 15:
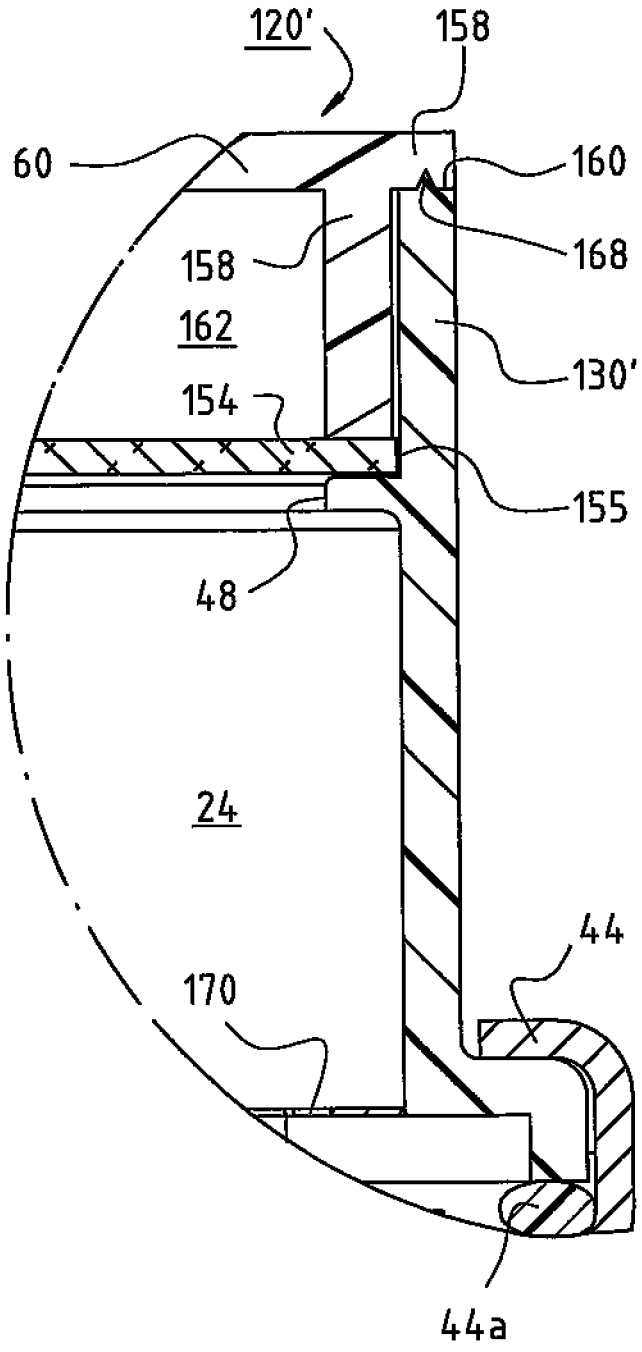
FIG. 15 is a section through the upper part of heat exchanger 120' depicted in FIG. 13.

Filter 170 can be made of metal or plastic, and according to FIG. 15 is mounted on the lower side of vessel 130', e.g. using the two-component injection molding method.

Figure 16:
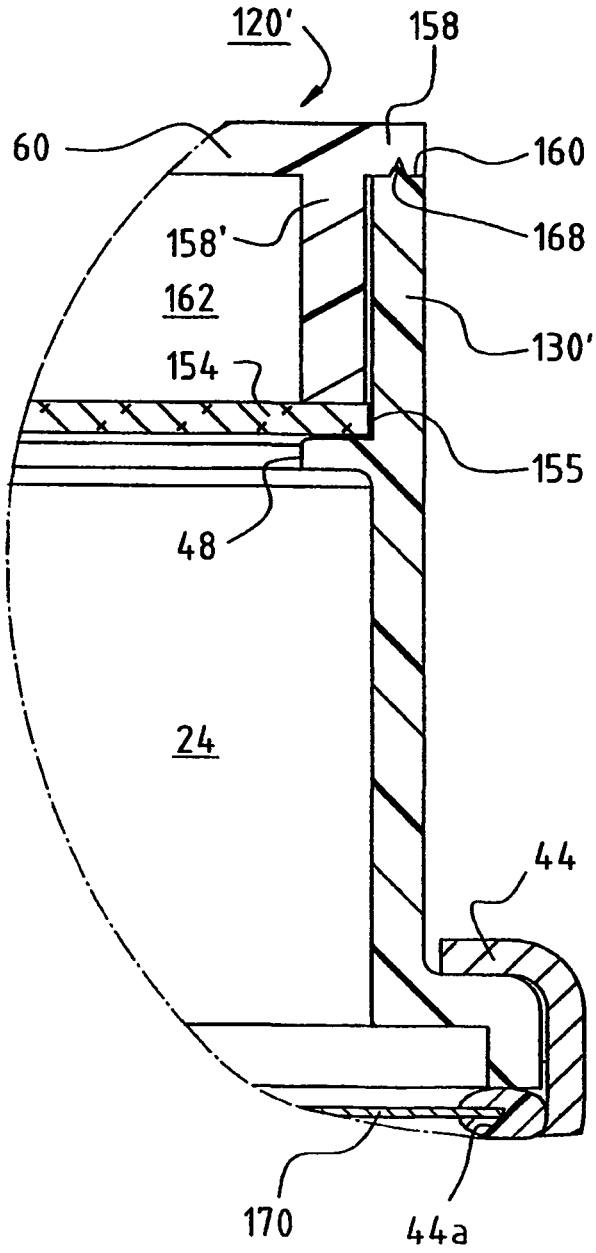
FIG. 16 is a section analogous to FIG. 15; in this variant, filter 170 is arranged and mounted differently than in FIG. 15.

FIG. 16 shows an alternative in which filter 170 is joined to seal 44*a* to form one module. This can be achieved, for example, by vulcanization. Alternatively, and particularly economically, it is possible e.g. to injection-embed filter 170 in TPE using the injection molding method. In both cases, assembly is simplified, and a very robust heat exchanger is obtained.

In the region of inflow 36, filter 170 filters cooling medium that flows via inlet 64 into vessel 130' and from there downward into flat tubes 22 of heat exchanger 20. Coarse dirt is thereby held back on the right side of filter 170.

The cooling medium then flows through the left half of flat tubes 22 from bottom to top, being filtered by the left half of filter 170 so that coolant, which has been filtered twice, flows through outflow 68 to pump 140 (FIG. 9).

This is important because pump 140 is very sensitive to contaminants in the coolant, and therefore must be particularly well protected, since contaminants could cause pump 140 to seize.

From pump 140, the coolant flows (according to FIG. 9) to heat absorber 74 and from there back to inlet 64.

The result of the large filter area, in the context of this innovative arrangement, is that the pressure drop at filter 170 becomes very low.

When a heat absorber that has been machined in chip-removing fashion is used, the machining chips that are created cannot be completely removed without reducing the efficiency of heat absorber 74.

In heat exchanger 20 as well, residual chips and dirt particles cannot be avoided during the manufacturing process, but at best can be reduced by soldering it under vacuum and then thoroughly rinsing and cleaning it.

The entry of dirt into the coolant circuit, during filling with coolant and subsequent testing, likewise cannot be entirely avoided.

The consequence is that chips and dirt might clog the small-scale structures in the heat absorber and thereby reduce efficiency. The danger also always exists that dirt particles may get into a narrow gap in pump 140 and thus cause blockage of the pump.

Such problems are eliminated by the invention. It is particularly advantageous that the invention yields a large filter area, and an additional filter housing can thus be eliminated. In the liquid circuit, chips and dirt particles that become detached in the heat absorber and heat exchanger are reliably held back on the outflow side at filter 170 before they flow into pump 140. The large filter area, relative to the amount of dirt that occurs, prevents clogging of the filter and an excessive pressure drop in the cooling medium in the circuit.

The invention therefore eliminates the need to provide a separate filter housing along with hose connections, thus reducing costs. In addition, no space is required for a separate filter housing and the requisite hose connections, enabling a compact design. Lastly, with the filter arranged as depicted (i.e. in the heat exchanger tank), chips that become detached from heat absorber 74 and heat exchanger 20 cannot get into pump 140, since the latter is arranged in the flow direction after heat exchanger 20 and before heat absorber 74. At no other location in the overall system, moreover, could the filter area be made so large without substantial additional cost. Clogging of the small-scale structures of heat absorber 74 is therefore prevented or greatly reduced in simple fashion, as is blockage of circulating pump 140.

An equalization vessel that is separate from the heat exchanger could of course also be manufactured using the same principle, for example if the volume of the heat exchanger is limited for space reasons. In other ways as well, many variants and modifications are possible within the scope of the present invention.

Figure 17:
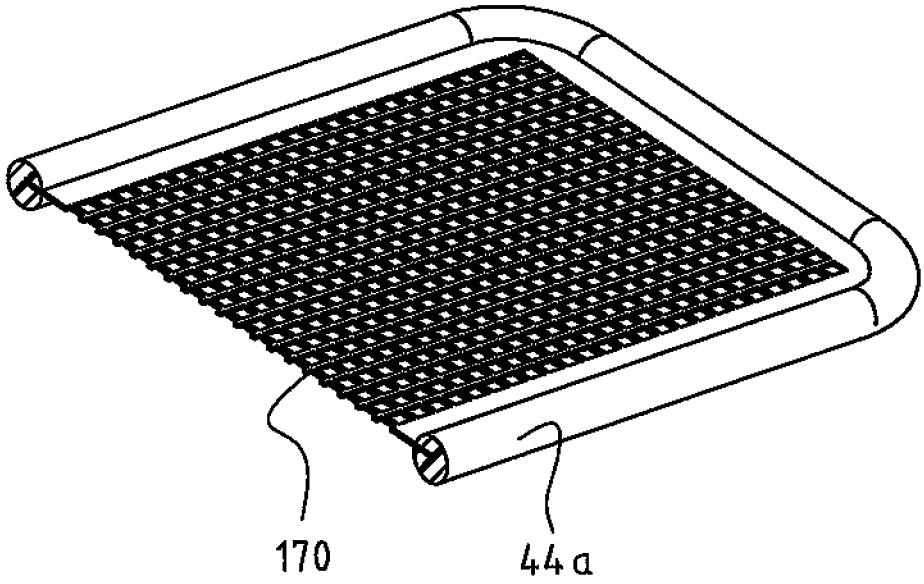
FIG. 17 is a sectioned detail depiction of the filter and the seal from FIG. 16.

FIG. 17 is a sectioned detail depiction of filter 170 and seal 44*a* of FIG. 16. Upon installation of filter 170 into heat exchanger 20, seal 44*a* is preferably deformed in order to produce a good seal (cf. FIG. 16).

The invention claimed is:

1. An apparatus for arrangement in a closed cooling circuit, the closed cooling circuit serving to cool at least one electronic component, comprising:

a heat exchanger, the heat exchanger including an inflow for delivering a coolant to the heat exchanger and an outflow for discharging the coolant from the heat exchanger;

an equalizing vessel capable of equalizing changes in coolant volume, the equalizing vessel joined to the heat exchanger to form one module, the equalizing vessel having a first chamber and a second chamber, wherein the first chamber of the equalizing vessel is in liquid communication with the inflow of the heat exchanger and the second chamber of the equalizing vessel is in liquid communication with the outflow of the heat exchanger; and a filter having a first filtering portion and a second filtering portion, the first filtering portion located within the one module, the first filtering portion in liquid communication with the first chamber of the equalizing vessel and the inflow of the heat exchanger, the second filtering portion located within the one module, the second filtering portion in liquid communication with the second chamber of the equalizing vessel and the outflow of the heat exchanger.

2. The apparatus according to claim 1, further comprising a flexible membrane that closes off the equalizing vessel.

3. The apparatus according to claim 2, wherein the flexible membrane closes off the first chamber of the equalizing vessel and a second flexible membrane closes off the second chamber of the equalizing vessel.

4. The apparatus according to claim 2, wherein the flexible membrane is braced, on a side of the flexible membrane facing away from the coolant, by at least one spring arrangement.

5. The apparatus according to claim 2, wherein the equalizing vessel further includes a cover, the cover includes a first rim, and the flexible membrane includes a second rim, wherein the first rim of the cover of the equalizing vessel abuts against the second rim of the flexible membrane and clamps the first rim of the cover of the equalizing vessel between the first rim of the cover of the equalizing vessel and the equalizing vessel.

6. The apparatus according to claim 5, wherein the rim of the flexible membrane is joined directly to the equalizing vessel.

7. The apparatus according to claim 2, further comprising:

a hermetically closed off space provided on a side of the flexible membrane, the side located opposite to the coolant.

8. The apparatus according to claim 7, wherein the membrane has a seam formed along a periphery of the membrane, wherein the hermetically closed off space is filled with a gas under positive pressure in order to counteract forces that act, as a result of a pressurized coolant, on the membrane and the seam.

9. The apparatus according to claim 1, wherein the filter is arranged within the one module formed by the equalizing vessel and the heat exchanger.

10. The apparatus according to claim 9, wherein the first filtering portion is provided adjacent the inflow of the heat exchanger.

11. The apparatus according to claim 9, wherein the second filtering portion is provided adjacent the outflow of the heat exchanger.

12. The apparatus according to claim 1, wherein the first filtering portion provides a first level of filtration and the second filtering portion provides a second level of filtration, wherein the first level of filtration is different from the second level of filtration.

13. The apparatus according to claim 1, wherein the filtering portion and the second filtering portion are joined to form a single module.

14. The apparatus according to claim 1, wherein the equalizing vessel is joined to the heat exchanger by a crimped joint.

15. The apparatus according to claim 14, further comprising:

a seal provided between the equalizing vessel and the heat exchanger.

16. The apparatus according to claim 15, wherein the seal is joined to a filter to form a unitary element.

17. The apparatus according to claim 16, wherein the seal is joined to the filter by one of injection-embedding and vulcanization.

18. The apparatus according to claim 1, wherein the heat exchanger is configured as a flat-tube heat exchanger.

19. An apparatus comprising:

a heat exchanger;

an equalizing vessel capable of equalizing changes in the volume of a coolant, the equalizing vessel having at least one connector for the inflow and/or outflow of the coolant, the equalizing vessel having a flexible diaphragm arranged at a first boundary between the coolant and an ambient gas, and a filter located at a second boundary between the equalizing vessel and the heat exchanger, wherein the heat exchanger, the equalizing vessel, and the filter are joined to form a single module.

20. The heat exchanger according to claim 19, wherein the filter includes a first filtering portion and a second filtering portion that are joined to form a single module, the first filtering portion providing a first level of filtration and a second filtering portion providing a second level of filtration, wherein the first level of filtration is different from the second level of filtration.

21. An apparatus comprising:

a heat exchanger;

an equalizing vessel capable of equalizing changes in the volume of a coolant, the equalizing vessel being joined to the heat exchanger to form a first single module; and a filter member for filtering the coolant, the filter member having a first filtering portion and a second filtering portion, the first filtering portion being arranged at a first transition from the heat exchanger to the equalizing vessel, the second filtering portion being arranged at a second transition from the equalizing vessel to the heat exchanger.

22. The apparatus according to claim 21, wherein the filter member is implemented as a plastic part, and the filter member is directly attached to a housing element of the equalizing vessel.

23. The apparatus according to claim 21, further comprising a seal joined to the filter member to form a second single module, the seal provided between the equalizing vessel and the heat exchanger.

24. The apparatus according to claim 23, wherein the filter member is joined to the seal by one of injection-embedding and vulcanization.

* * * * *